US005419393A

United States Patent [19]

Guy, III

[11] Patent Number: 5,419,393

[45] Date of Patent: May 30, 1995

[54] COLD PLATE

[75] Inventor: Thomas L. Guy, III, San Antonio, Tex.

[73] Assignee: Lancer Corporation, San Antonio, Tex.

[21] Appl. No.: 45,995

[22] Filed: Apr. 12, 1993

[51] Int. Cl.[6] ..... F28F 3/12

[52] U.S. Cl. ..... 165/168; 62/389; 62/393

[58] Field of Search ..... 62/389, 390, 393, 394, 62/396, 398, 399, 400; 222/129.1, 146.6; 165/168, 169

[56] References Cited

U.S. PATENT DOCUMENTS

| | | | |
|---|---|---|---|
| 1,702,565 | 2/1929 | Foster | 165/169 |
| 1,799,991 | 4/1931 | Sellick et al. | 165/169 |
| 2,192,431 | 3/1940 | Briggs | 165/169 |
| 4,555,045 | 11/1985 | Rodth et al. | 165/169 |
| 4,958,505 | 9/1990 | Swanson | 62/389 |
| 5,249,710 | 12/1993 | Hassell et al. | 222/146.6 |

*Primary Examiner*—John M. Sollecito
*Attorney, Agent, or Firm*—Donald R. Comuzzi; Christopher L. Makay

[57] ABSTRACT

A cold plate includes a recessed area in its underside so that its inner tubes will not migrate away from its top surface during its casting process. By restricting the movement of the tubes during the casting process, the cold plate has tubes located close to its top surface, thereby improving the heat transfer between fluids flowing through the tubes and ice placed over the cold plate to act as a heat sink. As a result, the cold plate allows drinks to be dispensed that are colder and retain more carbonation.

1 Claim, 1 Drawing Sheet

COLD PLATE

BACKGROUND OF THE INVENTION

1. Field of the Invention

The present invention relates to cooling apparatus of the cold plate type and, more particularly, but not by way of limitation, to an improved cold plate having increased efficiency and drink dispensing capacity.

2. Description of the Related Art

Typical cold plates feature rectangular castings of a metal such as aluminum that surround tubes of another metal such as stainless steel. The casting transfers heat from fluids flowing within the tubes to ice residing on the top surface of the casting. Such cold plates normally reside in the bottom of an ice storage container with the ice storage container serving the dual purpose of absorbing heat from the fluids flowing through the cold plate and storing ice to be dispensed with the beverage. In the particular application of cooling and dispensing carbonated beverages, the tubes in the casting connect at their inlets to a carbonator, a water source, and a beverage syrup source to carry carbonated water, plain water, and the beverage syrup throughout the casting. The outlets of the tubes connect to mixing valves which dispense the carbonated water, plain water, and beverage syrup to produce the carbonated beverage drink.

Cold plates utilize the ice placed on their top surface as a heat sink which absorbs heat from the carbonated water, water, and syrup as they flow through the tubes within the castings. That heat transfer results in the ice changing phase (i.e., solid to liquid). Thus, the ice absorbs the heat as latent heat which means the overall temperature of the ice, when used as the heat sink, does not significantly increase. In that way, the heat capacity of the heat sink is greatly increased over what it would be if, for example, liquid water cooled to a freezing temperature were employed as the heat sink.

Although ice provides an efficient heat sink, the efficiency of the heat transfer process between the ice and cold plate limits the cooling imparted to the fluids flowing through the cold plate. Both the position of the tubes within the casting and the surface area of the top surface of the casting determine the efficiency of the heat transfer process. With respect to the surface area of the casting, a larger surface area transfers greater amounts of heat. However, beverage dispensers must occupy as little counterspace as possible; therefore, the top surface areas of the castings may not be enlarged sufficiently to produce a significant increase in the efficiency of the heat transfer process.

Alternatively, changes in the position of the tubes within their castings may be effected to produce a more efficient heat transfer process. That is, tubes located closer to the top surface of the casting will transfer more heat from the fluids to the ice than tubes located further from the top surface. Unfortunately, as shown in related art FIG. 1, the rectangular shapes of typical cold plates allow the tubes to migrate away from the top surface of the casting during the cold plate molding process. The molding of the tubes away from the top surface of the casting places a thicker layer of the casting between the tubes and any ice laid on the top surface of the casting. As a result, the heat transfer between the fluid flowing through the tubes and the ice over the top surface of the cold plate greatly diminishes. Accordingly, a cold plate that minimizes the distance between the tubes and the top surface of the casting is needed.

SUMMARY OF THE INVENTION

In accordance with the present invention, a cold plate provides tubes which reside close to the top surface of the casting, thereby, enhancing the heat transfer process between the cold plate and the ice. Essentially, the design of the cold plate is such that movement of the tubes during the molding of the casting does not occur, thus, ensuring the tubes are located close to the top surface of the cold plate. Because the tubes in the cold plate of the present invention reside closer to the top surface of the casting than in typical cold plates, cold plate capacity significantly increases resulting in dispensed drinks that are colder and that retain more carbonation.

The cold plate of the present invention includes a recessed area in the underside of the casting that eliminates the movement of the tubes during the molding of the casting. As a result, the tubes reside closer to the top surface of the casting than in typical cold plates. Specifically, the recessed area reduces the cross-sectional area of the underside of the casting, thereby forcing the tubes within the casting to a position just below the top surface of the casting.

It is, therefore, an object of the present invention to provide a cold plate with an improved capacity resulting in dispensed drinks that are colder and that retain more carbonation.

It is a further object of the present invention to provide a cold plate with a recessed area in the underside of its casting to eliminate the movement of the tubes during the molding of the casting.

Still other features, objects, and advantages of the present invention will become evident to those skilled in the art in light of the following.

DETAILED DESCRIPTION OF THE PREFERRED EMBODIMENT

Figure 1:
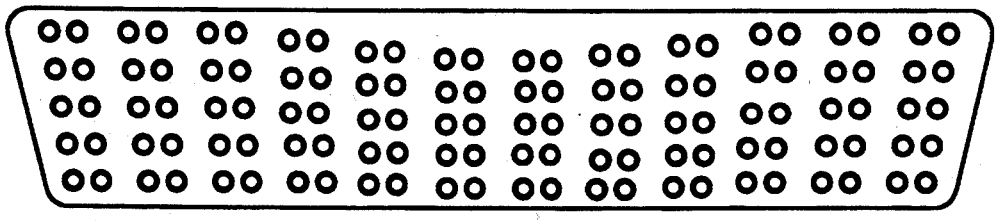
Fig. 1 (PRIOR ART)
FIG. 1 is a cross-sectional front view depicting a related art cold plate having tubing which has migrated away from the top surface of the casting during the molding process of the casting.
Figure 2:
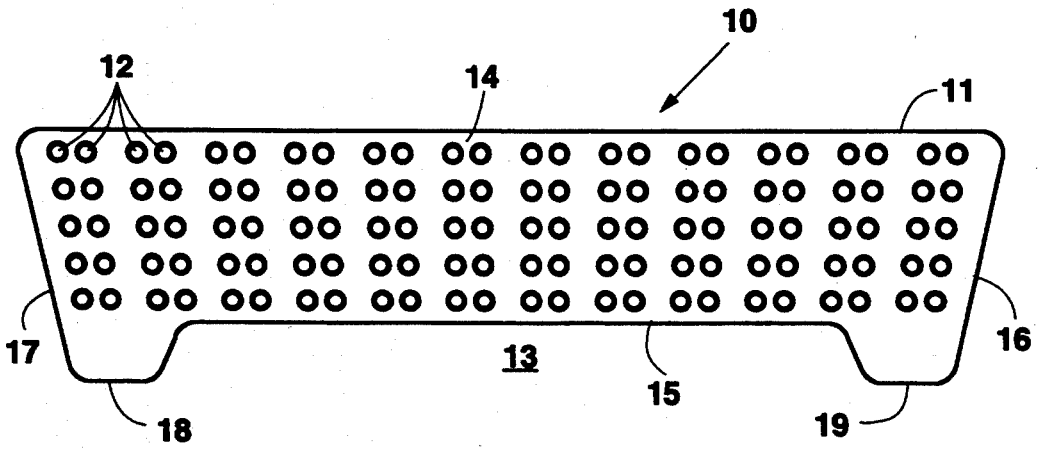
FIG. 2 is a front cross-sectional view depicting the cold plate according to the preferred embodiment of the present invention.

As shown in FIG. 2, cold plate 10 comprises casting 11 made from any metal such as aluminum or an aluminum alloy and tubes 12 made from any metal such as stainless steel. To form cold plate 10, tubes 12 are bundled together with retainers (not shown) and then placed within a mold. The mold in the preferred embodiment of the present invention includes a raised portion positioned in its bottom surface to produce the recessed area 13 in cold plate 10 shown in FIG. 2. After tubes 12 have been properly positioned within the mold, any conventional casting process is employed to cast aluminum or an aluminum alloy about tubes 12 to produce cold plate 12 as depicted in FIG. 2.

Accordingly, after the aluminum or aluminum alloy has been poured and has hardened, casting 11 surrounds tubes 12 with tubes 12 residing close to top surface 14 of casting 11. The mold in the preferred embodiment of the present invention produces casting 11 such that it includes top surface 14, bottom surface 15, sides 16 and 17, and two additional sides (not shown). Furthermore, the casting 11 includes raised portions 18 and 19 in its bottom surface wherein raised portions 18 and 19 define recessed area 13 within the bottom surface of casting 11.

In standard rectangular cold plates, the rectangular castings provide insufficient support for the bundles of tubes to prevent them from migrating away from the top surface of the casting. As a result, a portion of the tubes are forced towards the bottom of the casting, resulting in excess aluminum or aluminum alloy between the top surface of the casting and the tubes.

In contrast, the raised portion in the mold of the present invention which produces recessed area 13 prevents tubes 12 from migrating away from top surface 14 of casting 11. Specifically, the raised portion of the mold supports tubes 12 so that the pouring of the aluminum or aluminum alloy into the mold will not distort the retainers of tubes 12 or force sections of the bundled tubes 12 away from top surface 14 of casting 11. That is, the raised portion of the mold produces casting 11 such that it has substantially the same height as the bundles of tubes 12. As a result, tubes 12 are held in place and have no room to migrate away from top surface 14 during the forming of casting 11.

Thus, because tubes 12 of cold plate 10 reside closer to top surface 14 of casting 11 than typical tubes in standard rectangular cold plates, cold plate 10 has an improved capacity. Consequently, cold plate 10 more efficiently cools carbonated water, water, and beverage syrup to provide dispensed drinks that are colder and retain more carbonation than typical rectangularly shaped cold plates.

Although the invention has been described in conjunction with the foregoing specific embodiment, many alternatives, variations, and modifications should be apparent to those of ordinary skill in the art. Those alternatives, variations, and modifications are intended to fall within the spirit and scope of the appended claims.

I claim:

1. A cold plate, comprising:

a plurality of tubes cast within a casting;

said casting having a top surface, a bottom surface underneath said top surface, and four sidewalls therebetween each having a height substantially equal to the height of said plurality of tubes; and said bottom surface having a first peripheral raised portion and a second peripheral raised portion each of which being adjacent to one of said side walls and extending downwardly from said bottom surface to define a substantially flat recessed area therebetween thereby defining means to enhance heat transfer through said top surface of said cold plate.

* * * * *